US009161648B2

(12) United States Patent
Graves et al.

(10) Patent No.: US 9,161,648 B2
(45) Date of Patent: Oct. 20, 2015

(54) TELESCOPIC TRAVERSING SYSTEM FOR RETRACTABLE WINDOW TREATMENTS

(71) Applicant: BEME INTERNATIONAL, LLC, San Diego, CA (US)

(72) Inventors: Brian Graves, San Diego, CA (US); Peisheng Qian, Shanghai (CN)

(73) Assignee: Beme International, LLC, San Diego, CA (US)

( * ) Notice: Subject to any disclaimer, the term of this patent is extended or adjusted under 35 U.S.C. 154(b) by 0 days.

(21) Appl. No.: 14/550,768

(22) Filed: Nov. 21, 2014

(65) Prior Publication Data

US 2015/0075734 A1 Mar. 19, 2015

Related U.S. Application Data

(63) Continuation of application No. 14/171,926, filed on Feb. 4, 2014, now Pat. No. 8,919,420, which is a continuation of application No. 13/353,253, filed on Jan. 18, 2012, now Pat. No. 8,708,026.

(60) Provisional application No. 61/523,136, filed on Aug. 12, 2011.

(51) Int. Cl.

| | |
|---|---|
| ***A47H 1/022*** | (2006.01) |
| ***A47H 1/122*** | (2006.01) |
| ***A47H 5/032*** | (2006.01) |
| ***A47H 1/18*** | (2006.01) |
| ***A47H 11/06*** | (2006.01) |

(52) U.S. Cl.

CPC ..... *A47H 1/022* (2013.01); *A47H 1/122* (2013.01); *A47H 1/18* (2013.01); *A47H 5/0325* (2013.01); *A47H 11/06* (2013.01)

(58) Field of Classification Search

CPC ..... A47H 1/122; A47H 1/022; A47H 5/0325; A47H 1/18; A47H 11/06

USPC ..... 160/330, 331, 333, 345, 197, 202; 211/105.3

See application file for complete search history.

(56) References Cited

U.S. PATENT DOCUMENTS

| | | | | |
|---|---|---|---|---|
| 2,863,505 | A | 12/1958 | Cameron | |
| 3,297,078 | A | 1/1967 | Miki | |
| 3,502,132 | A | 3/1970 | Hager et al. | |
| 3,879,800 | A | 4/1975 | Adams | |
| 3,946,791 | A | 3/1976 | Brown | |
| 4,251,124 | A | 2/1981 | Emanual | |
| 4,492,262 | A | 1/1985 | Comeau | |
| 6,085,826 | A | 7/2000 | Maesaki | |
| 6,827,121 | B2 | 12/2004 | Park | |
| 8,708,026 | B2 * | 4/2014 | Graves et al. | 160/330 |
| 8,919,420 | B2 * | 12/2014 | Graves et al. | 160/330 |
| 2006/0162877 | A1 | 7/2006 | Chou | |
| 2013/0037504 | A1 | 2/2013 | Graves et al. | |

* cited by examiner

*Primary Examiner* — Blair M Johnson

(74) *Attorney, Agent, or Firm* — Stetina Brunda Garred & Brucker

(57) ABSTRACT

A variable length support rod apparatus for translational support of a window treatment, such as draperies, comprised of a support member formed of a plurality of transnationally engaged segments, the support member is infinitely configurable from a minimum contracted length to a maximum extended length through a translation of the plurality of segments toward or away from each other. A continuous flexible member is positioned along a pathway running between a first end and a second end of the support member. The support rod may be configured to any length between the minimum and maximum lengths and may be fixed to a support surface without an adjustment of the fixed length of the continuous flexible member.

16 Claims, 5 Drawing Sheets

TELESCOPIC TRAVERSING SYSTEM FOR RETRACTABLE WINDOW TREATMENTS

This application is a continuation of U.S. patent application Ser. No. 14/171,926 filed on Feb. 4, 2014, which is a continuation of U.S. patent application Ser. No. 13/353,253 filed on Jan. 18, 2012, which claims priority to U.S. Provisional Application Ser. No. 61/523,136 filed on Aug. 12, 2011 and incorporated in its entirety be reference thereto.

BACKGROUND OF THE INVENTION

1. Field of the Invention

The present invention relates generally to drapery rods employed for supporting draperies, vertical blinds, and other such retractable window treatments. More particularly the device relates to a telescoping drapery support rod or housing, which may be motorized or may be operated by hand.

The device provides great utility to the art in that unsophisticated users, such as homeowners, can install the device to conform to a wide variety of different sized window widths with no modification to the device. Width adjustments for installation are easily accomplished without the need to cut or otherwise modify or alter the mechanical components engaged to form the rod. Neither is there any need to cut the flexible member such as a cable or cord, which remains fixed in length, no matter the installed length of the telescopic rod. Once installed, the device is immediately operable for the translation of draperies and the like, from closed to open positions.

2. Prior Art

Conventional drapery rods provide a mount for curtains, blinds, and other window treatments of which can be smoothly slid to closed or open positions. Typically the support rod is a round or rectangular tube wherein hooks or support rings are slidably engaged in a formed track or upon the exterior of the tube. The support rings engaged upon the tube provide translating mounting points for individual blinds, fabric curtains, or the like.

Alternatively, conventional support rods may internally house a system of gears and pulleys along with flexible members such as ropes or cables engaged thereon to operate along a serpentine path. Hooks or support rings are engaged to portions of the flexible member and traverse a path along the length of the rod as the flexible member does the same. Translation of the flexible member, such as an internal cable or rope about the pathway, is provided through employment of a manually-powered or a motorized drive pulley operatively engaged therewith. In this fashion, translation of the flexible member, translates the hooks or support rings along a track to render the hanging window treatment to the desired closed or open position.

The flexible member so formed of a cord or rope and operatively engaged with pulleys provides a number of travel paths for engaged blinds or curtains. So engaged, the blinds or curtains located on an opposite distal end of the rod, can be simultaneously translated toward and away from a midpoint between an open and closed position. An alternative closed position may also be accomplished by translating blinds or curtains located at one end of the rod, to the other end.

As can be seen, conventionally, the flexible member provided by the moving cable or rope, accomplishes the translation of the engaged curtain or blinds in either direction. Movement in both directions is provided by translating the flexible member in a continuous serpentine path about a continuous looping track formed around pulleys from one end of the rod to the other in a substantially horizontal fashion. In this conventional configuration, engaging draperies to the rope or cable on either side of the looping track at the distal ends, and driving the drive pulley to translate the engaged rope or cable, will cause the draperies to simultaneously translate.

In more recent years due to increased demand, manufacturers have begun to provide more expensive higher quality models of drapery rods which are motorized to cause a powered translation of the engaged draperies or curtains. Such motorized configurations are conventionally significantly more expensive and they are thus often seen in luxury homes and hotels.

With the provision of motorized drapery rods, a user is provided with an effortless means to close and open blinds and curtains with the push of a button. While such current motorized versions are high priced, there is additional expense due to the custom sized nature of each individual drapery rod requiring customized manufacturing and the required expert installation.

Such customization is labor intensive and by nature very expensive since conventional motorized drapery rods currently on the market must be manufactured offsite. However this is only after the required measurements and dimensions of each specific window are taken by installers knowledgeable in the art.

Once the custom measurements have been taken and the desired length is known, further customization is often required. This requires that the custom-sized rod have the mechanical components such as the pulleys, ropes, and gears operatively fixed with a support rod engaged to the measured length, whereafter a motor is attached.

In operation, the motor essentially performs the function of translating the rope or lanyard which conventionally was performed by the user manually pulling a vertically disposed cable or rope. Such a device can be seen in US. Pub. No. US2009/0283225A1 to Luger.

However, this and similar conventional motorized drapery devices fall short for widespread manufacture and use in that the mechanical components driving the operations of the device, are generally fixed within the device only after the desired length for the rod at its installation position on a window has been determined. Again, this requires professional measurement and installation far beyond the scope and ability of homeowners.

Consequently, these desirable motorized curtain rods must be custom built for each respective differently-sized window. This not only drives up costs it also increases assembly time and restricts widespread use. Additionally, if the curtain rod is mistakenly manufactured in the wrong length to accommodate a particular window width, the housing forming the rod cannot simply be extended or shortened to correct the imperfect length without a complete alternation of all the internal mechanical components. This is especially true where the flexible member is employed around fixed pulleys to operate the drapes or other window treatment.

As a consequence, the manufacture, installation, and use of motorized drapery and curtain rods, continues to be expensive and generally installed only in luxury homes and hotels. As such, there is a continuing and unmet need for an adjustable manual or motorized traversing drapery rod system, which is user-adjustable on-site to match the installation requirements. Such a device should allow for manufacture of traversing drapery rods in sizes which expand and contract to fit a plurality of different windows between a maximum and minimum size. Such a device should be easily extended and contracted to a desired length for a respective installation, without the need to alter the mechanical components or cables or belts or ropes which drive the operations of the device. Such a device would as such, be so easy to install since no alterations or cutting are required on-site, to adapt it to window widths, that adept laypersons and homeowners can install them without difficulty.

SUMMARY OF THE INVENTION

The device herein disclosed and described provides a solution to the shortcomings in prior art and achieves the above noted goals through the provision of a telescoping, manual or motorized traversing drapery mount, which is easily user-configurable on-site to numerous lengths between a maximum and minimum length. This configuration is easily accomplished without alteration of the rod components or segments or the flexible member such as a belt, cable, or cord, and other mechanical components functioning internally.

The support rod of the device generally includes at least two concentrically engaged housing segments or components which translate in a relative telescopic engagement. Additional mechanical components engaged within the housing include the operatively configured pulleys or gears, and a flexible member formed in a continuous loop, which may be formed of any material flexible and adapted to move through the serpentine pathway such as a belt, a cable, a rope, a lanyard, a chain, or the like.

In a preferred mode, a motor may be operatively engaged with a proximal end of the support rod as a means for powering a drive pulley to cause the translation of the flexible member driving a translation of the window treatment supported thereon. However, in an additional mode of the device a vertically disposed secondary cable, cord, belt, or rope, can be employed for driving the drive pulley manually or with a remotely engaged motor.

A continuous looped linear media or flexible member, such as a cable, a cord, a chain, a belt, a rope, a wire, or other flexible members capable of operating in the formed serpentine path, is employed in all modes of the device. This flexible member is formed in the continuous loop in a fixed length matching the length of the formed serpentine path, and is engaged about the drive pulley. In this engagement the formed pathway of the flexible member extends toward the distal end of the housing in one plane, and toward the first end in a second plane, while operatively engaged with aligned pulleys for guiding the member about the continuous path.

Employing the telescopically engaged rod segments, and flexible member drive system along the formed member pathway, the device is rendered easily adjustable on-site between a maximum and minimum length. The rod length is infinitely adjustable in length, between the maximum and minimum length, by translating the engaged segments toward or away from each other. Once a desired rod length is reached, the support rod segments then may be locked or otherwise secured at this desired final length using the support rod mounts to a wall or other means of securement.

As can be discerned, great utility is provided by the fact that there is no need to cut or change the length of the internally housed flexible member when the support rod providing the drapery mount is at any length between the maximum extended length or a shortened length. Nor is it necessary to cut or alter the drapery support rod length other than by simply telescoping it to the desired length.

It must be noted that the term 'cable' herein refers to any linear media or flexible member known in the art such as a rope, lanyard, cord, chain, wire, belt, etc. and should therefor not be considered limited to the conventional definition. Because the disclosed device employs directional changes along the formed cable pathway, and because smoothness and quiet operation is always a concern, a belt such as that employed to drive sewing machines or car generators is a particularly preferred mode of the flexible member herein. However, those skilled in the art should appreciate that the flexible member or linear media employable within the scope of this invention, as will be set forth in this disclosure, when referenced as 'cable' is so referenced merely for simple descriptive purposes. Consequently, any flexible member as would occur to those skilled in the art, on reading this disclosure, is considered within the scope of this patent and its claims.

Particularly rendering the device easy to install, is the fact that the drive cable length is fixed, and need not be adjusted when the housing is translated between its long and short positions. The cable is engaged about its ends along an adjustable serpentine path relatively rendering it as 'endless' in that the rotation of the motor or manually-powered pulley, translates the cable on a continuous loop about the drive pulley and successive pulleys forming the pathway therein. As such, for convention, whether the motor or manually-powered drive pulley is driven clockwise or counterclockwise, there will always be an 'outgoing' and 'incoming' section of cable relative to the drive pulley. The translation of the sections of cable therefor provides a means to translate operatively engaged blinds or curtains from open to closed positions.

It must further be noted that the terms 'drapery', 'blinds', and 'curtains' herein may also refer to any such window treatment known in the art which is conventionally engaged to translate along with a flexible member and should not be considered limited by their conventional definitions. Those skilled in the art will appreciate the plurality of such window treatments employable within the scope of the invention as will be set forth in this disclosure while the terms 'blinds' and 'curtains' will be referenced merely for simple descriptive purposes for conveying the intended scope and operation of the present invention.

In a particularly preferred mode, the open position is defined as having a first set of curtains engaged on the 'outgoing' section of cable adjacent the drive motor, while a second set of curtains is engaged upon the 'incoming' section of cable at the distal end. The closed position is then achieved by powering the drive pulley to translate the cable such that the 'incoming' section translates the curtains at the distal end toward the motor and proximal end, while the 'outgoing' section translates the curtains located near the drive pulley away from the proximal end. A final closed position is achieved such that a set of curtains meet at a midpoint between the two ends, essentially closing the curtains.

In yet another particularly preferred mode the device may translate the curtains in the conventional left-to-right or vise versa open/close configurations. In this mode, the open position may be defined as having a set of curtains engaged at the proximal end on the 'outgoing' section of cable adjacent the drive pulley. The closed position is then achieved by engaging the drive pulley to translate the cable such that the 'outgoing' section translates the curtains toward the distal end, essentially drawing the curtains to cover the window. Alternatively, the set of curtains may be engaged at the distal end on the 'incoming' section of cable. The closed position is then achieved by engaging the drive pulley to translate the cable such that the 'incoming' section translates the curtains toward the proximal end, again drawing the curtains to cover the window in a closed position.

The telescoping segments in combination with the static size requirement of the flexible member or cable to operate along the formed pathway, allow the device to be universally employed on a window without the need to be pre-measured and exactly dimensioned to that specific window. Neither is any on-site adjustment of the drive cable length required allowing any user to easily and confidently correctly size and install a desired window treatment employing the present invention.

As such, the device may be factory-configured by a manufacturer employing single length cable which is operatively engaged to the telescopic housing forming the adjustable rod. When shipped, the device is ready for a nonprofessional user to simply perform real-time on-site extension or contraction of the telescopic rod to conform and fit any window at hand. This adjustable support rod, with no requirement for cable adjustment, provides great utility in that employment of the device does not require a skilled tradesman or construction know-how. Further, it is within the scope of the device to be operated by hand or remotely through wireless or wired engagement with a controller for a drive motor.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

It is an object of this invention, to provide a telescopic traversing system for retractable window treatments which is easily adjusted in length on-site, to fit a variety of different width windows and installation points.

It is a further object of this invention, to provide such a telescopic traversing system for retractable window treatments, which also employs a cable or other flexible member, having a static length which will automatically adjust to the extended length of the support rod.

It is an object of the invention to provide a mechanized system for retractable window treatments having telescopically engaged housing segments for easily extending or contracting the final deployed length of the device.

It is an object of the invention to provide a telescoping mechanized drapery mount which may be operated through remote or wired engagement with the motor or by employment of a hand-driven pulley system.

It is a further object of the invention to provide such a length-adjustable system for retractable window treatments, which needs no drive cable adjustment when it is reduced or increased in length, thereby maximizing the ease of installation.

It is a further object of the invention to provide such a length-adjustable system for retractable window treatments, which requires no cutting or other permanent length adjustments to the length of the drapery mount when sizing to a window. The only length adjustment required can be achieved by simply telescoping the drapery mount to size, thereby maximizing the ease of installation.

These together with other objectives and advantages which become subsequently apparent reside in the details of the system for retractable window treatments and method herein as more fully hereinafter described and claimed, reference being had to the accompanying drawings forming a part thereof, wherein like numerals refer to like parts throughout.

BRIEF DESCRIPTION OF DRAWING FIGURES

Figure 6:
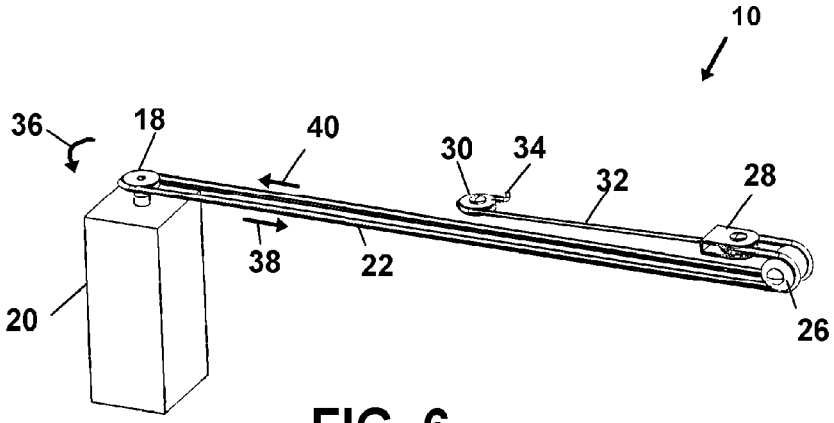
FIG. 6 shows an elevated view of the mode of the device of FIG. 5 with the housing segments omitted for clarity.
Figure 6A:
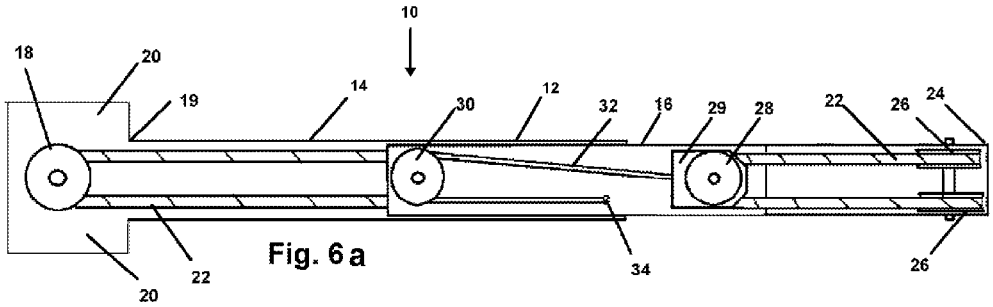
Figure 6B:
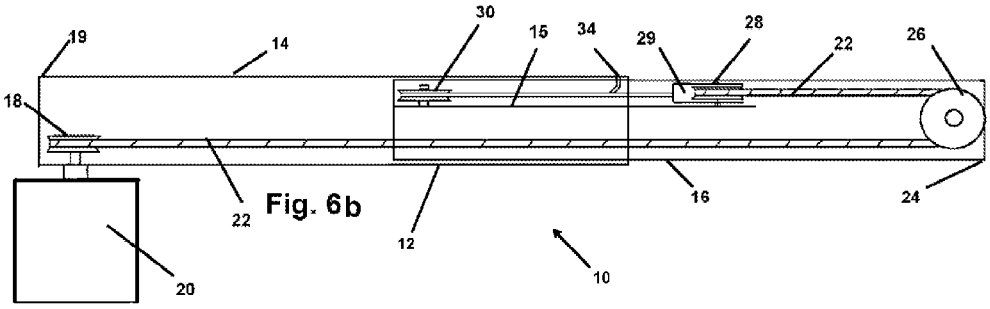

FIGS. 6*a* and 6*b* show enlarged views of the two planes of which the serpentine pathway for the flexible member and the relative adjustment of the length of each plane to accommodate length changes in the housing.

Figure 7:
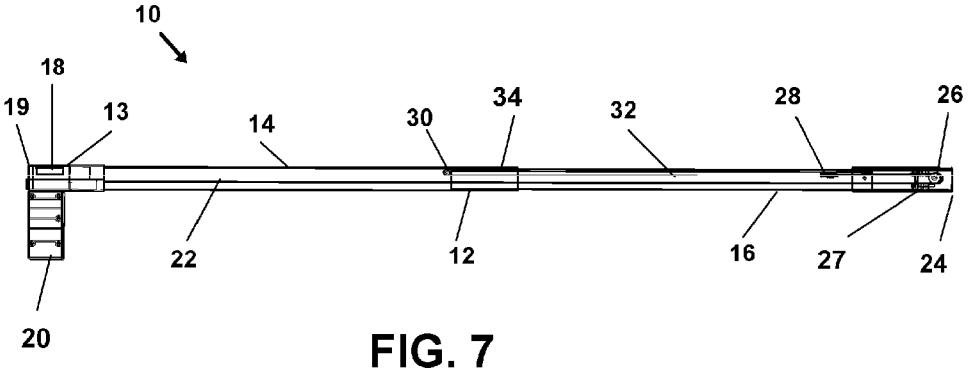

FIG. 7 shows a side view of yet another preferred mode of the device.

Figure 8:
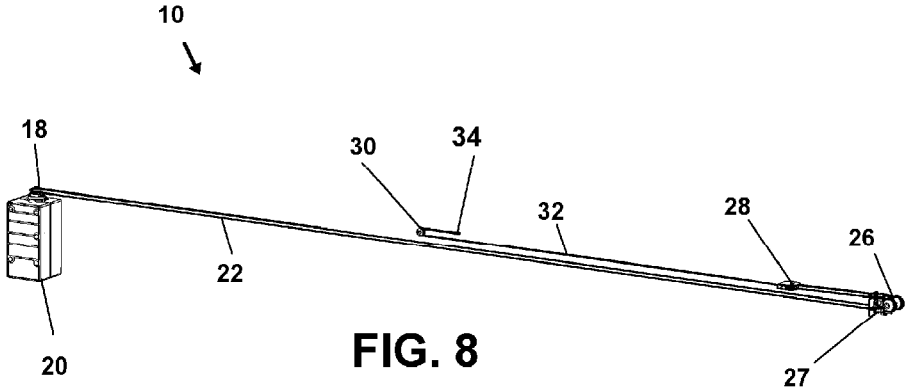

FIG. 8 is an elevated view of the device of FIG. 7 with the housing segments omitted for clarity.

Figure 8A:
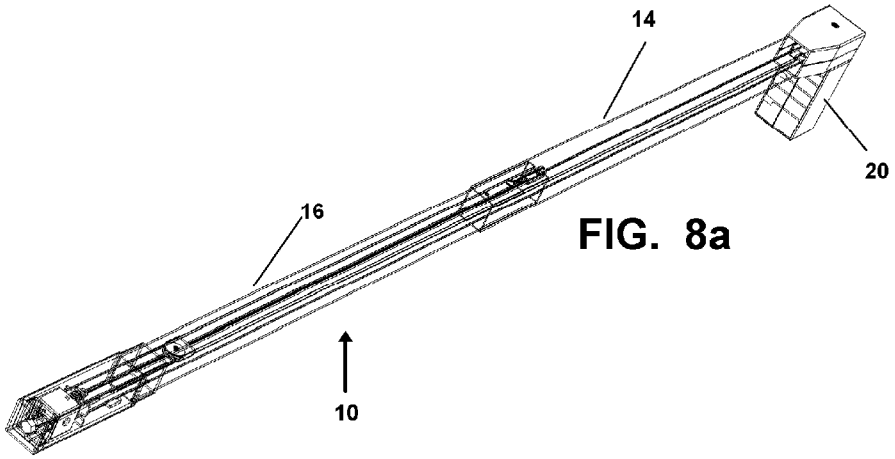

FIG. 8*a* is a transparent overhead perspective view of the device of FIGS. 7-8 showing the operation of the system.

Figure 9:
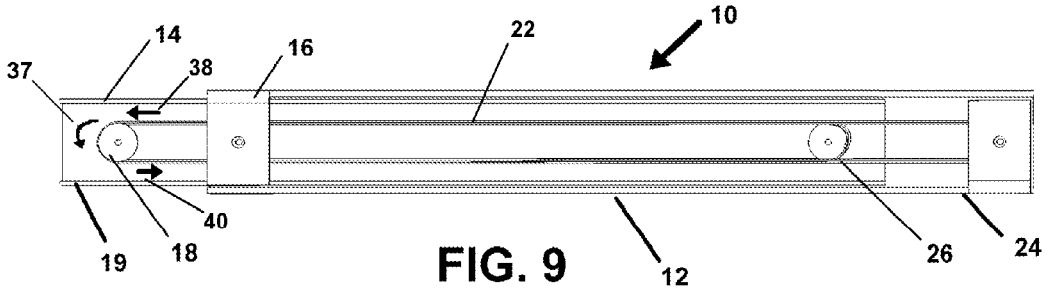

FIG. 9 depicts a simple mode of the device also adapted for manual or motorized operation which employs a static sized cable or other flexible member no matter the length of the housing.

Figure 10:
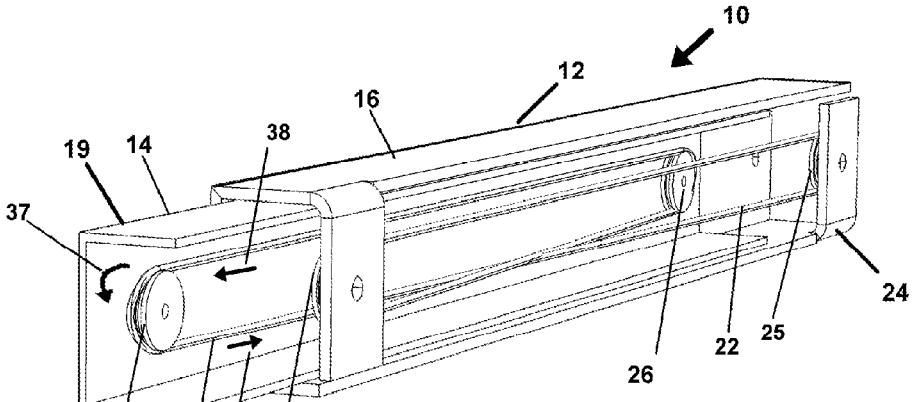

FIG. 10 is a perspective view of FIG. 9.

Figure 11:
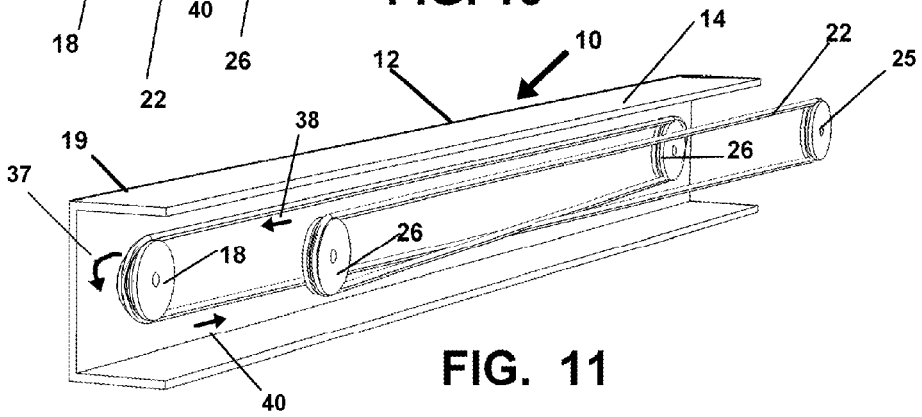

FIG. 11 is a view of FIG. 10 wherein one of the segments forming the housing forming the rod is removed for viewing the serpentine pathway of the fixed-sized flexible member which is internally engaged.

DETAILED DESCRIPTION OF THE PREFERRED

Embodiments Of The Invention

Figure 1:
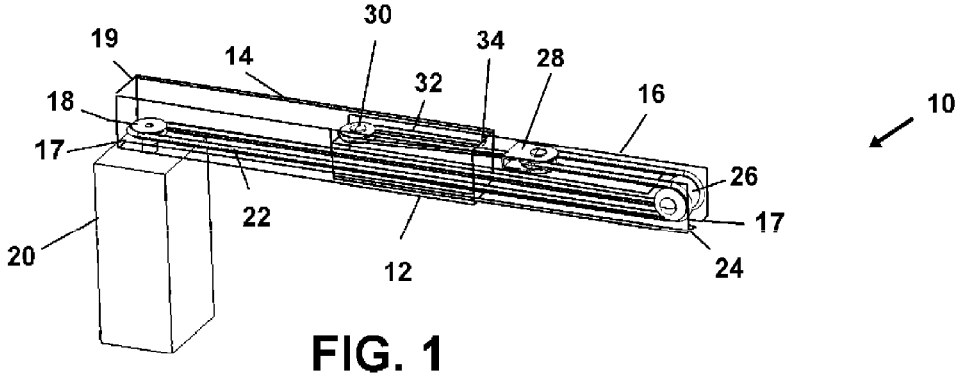
FIG. 1 shows an elevated view of the device with telescopically engaged housing segments in a substantially retracted mode, the housing segments are shown as transparent for clarity.
Figure 2:
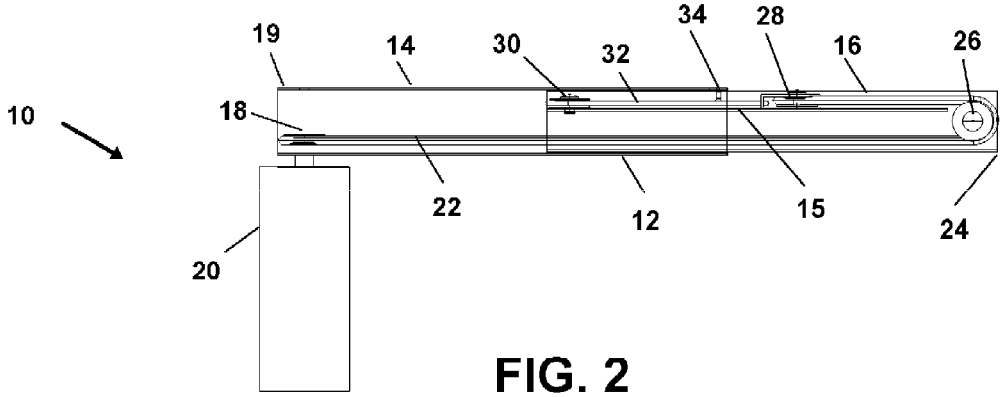
FIG. 2 shows a side view of the mode of the device of FIG. 1.

Now referring to drawings in FIGS. 1-11, wherein similar components are identified by like reference numerals, there is seen in FIG. 1-2 an elevated perspective and a side view respectively, of the device 10. The device 10 is shown including a telescopic support formed by a segmented housing 12. The support depicted as the housing 12 is formed of a plurality of segments which as shown include at least a first segment 14 segment and translatably engaged adjacent second segment 16 segment.

Currently two to three segments forming the plurality of segments forming the support rod 12 is particularly preferred for ease of manufacturing and user-installation simplicity. However it is envisioned that persons skilled in the art, upon reading this disclosure, will realize different numbers of translatably engaged pluralities of segments, such as four, or five, can be employed to form the support formed by the support rod 12.

The support rod formed by the plurality of segments, is employed with the disclosed flexible member in the form of a loop of continuous cable 22 to provide movement to the mounted window treatment and yield the novel user-installable device 10 herein. The maximum length of the support rod 12 is determined by the maximum translation of each respective segment away from the other, while the minimum length of the support rod 12 is determined by the maximum translation and overlap of all of the respective segments with each other. The usable length of the support rod 12 is thus infinitely variable between the maximum length and the minimum length by a simple adjustment in the translatable engagement of any two segments forming the support rod 12.

Such a translatable engagement of adjacent respective segments may be smooth as to be nearly frictionless, or may employ an element of frictional engagement, so as to allow the device 10 to securely maintain its position once retracted or extended. In use in one mode, a user may maintain the first segment 14 substantially stationary being held in one hand, while the second segment 16 is telescopically translated to achieved the desired extended position and length, as will be described shortly in FIGS. 4-6 and 9-11. In this fashion the support rod 12 can be extended in length between a maximum and minimum length for the installation at hand, and anywhere in-between.

In all modes however, the internal flexible member depicted as cable 22, is engaged to follow a serpentine path and the cable 22 remains fixed in length no matter the telescoped length of the support rod 12 between minimum and maximum lengths. As a consequence, unlike existing products in the art in which a change in support rod length causes the need for a length change for the cable, the cable 22 of the device herein, needs no length adjustment whatsoever when installed. As noted, this is accomplished via the operative configuration of the flexible member 22 and associated pulleys or gears forming the serpentine path, as herein described.

Additionally, as noted herein already, the device 10 may include additional telescopically engaged support rod 12 segments and achieve the same, or an increased maximum length as will become apparent to those skilled in the art upon further disclosure of the present invention. As such, the descriptions and depictions set forth should not be considered limiting.

It should be further noted, that some of the figures show the support rod 12 substantially transparent as to more clearly depict the mechanical drive components housed within. However, the segments forming the support rod 12 are preferably an opaque material such as a plastic or lightweight metal like aluminum, or other material as one skilled in the art would recognize for employment within the scope of the invention.

Still further, the motor 20 and support rod 12 may in other preferred modes of the device 10 be formed more aesthetically pleasing as the purpose of the device 10 is to be employed within a living space of the user where, more than often, aesthetics are considered. Consequently, those skilled in the art will appreciate that the depictions herein set forth are the simplest form in a manner merely portray the intended operations of the disclosed device 10 and should not be considered limiting in any fashion.

With regard to operation of the device once installed, it is within the scope of the invention herein, that the motor 20 may be omitted and instead a conventional vertically disposed flexible member such as a conventional pulley engaged pull cord (not shown) may be employed as a manual means to drive the operations of the device 10 in all modes herein. This would be engaged with drive pulley 18 in a conventional fashion or using a geared version of pulley 18 and a vertical cooperating gear engaged with the vertical pull cord or rope. Consequently, those skilled in the art will appreciate the simple modifications as needed for the employment of a well-known manual pull cord, or other conventional manual drive means, in place of the motor 20. Consequently, all such means to communicate translation to the cable 22 as would occur to those skilled in the art, are anticipated to be within in this disclosure and the resulting patent herefrom. In addition, the location of either the motor 20 or manual drive while depicted in the manner herein, may also occur at any of pulleys 18, 26 or 28 or along the mechanized drive system in a position where one skilled in the art would locate or communicate the rotational power of a motor 20.

In one preferred mode of the device 10, at the proximal end 19 of the support rod 12 a drive pulley 18 is operatively communicating with the drive motor 20. As can be further seen, the drive cable 22 communicates in a frictional engagement with the drive pulley 18 from the proximal end 19 to the distal end 24 of the support rod 12 at the second end 16. In one particularly preferred mode for configuration of the device 10, shown in FIGS. 1-6, the serpentine path of the fixed-length cable 22 is formed by operative engagement with vertical pulleys 26 with a reverse point at translating pulley 28 best seen in FIGS. **6*a*-6*c*. This pulley engagement provides a reverse communication of the cable 22 to a direction substantially 180 degrees in the reverse of itself upon further communication of the cable 22 with the translating pulley 28, and thereby forming a continuously looping track of the cable 22**.

As noted, all modes of the device 10 employ a fixed length cable 22 which will function with the telescopic support rod from its shortest length to its longest. The distance between the vertical pulleys 26 and the translating pulley 28 determine the maximum length that the distal end 24 of the second support rod segment 16 can telescopically translate away from the proximal end 19 and still operate.

As can be discerned from the drawings, in particular FIGS. **6-6*b*, there is shown the two planes in which the two portions of the cable 22 follow along the pathway and these two portions are of varying lengths depending on the length of the support rod 12. The length of the cable 22 in a second plane is shorter than, and changes, in direct relation to the length of the cable 22 running in a first plane which extends between a point adjacent to the proximal end 19 and a distal end 24**.

Accommodating the telescoping length change of the support rod 12, the lanyard 32, formed by a flexible material such as cable, cord or belt, is attached at end 34 to first segment 14, communicates around the tracking pulley 30, then is attached to translating pulley 28 using means of attachment thereto. The lanyard 32 adjusts the relative position of pulley 28 when the support rod 12 is lengthened or shortened, maintaining the overall length of the second plane of cable 22 along the translating pulley 28 and the vertical pulleys 26 and the drive pulley 18 to thereby accommodate the length change of the support rod 12, when the translating pulley 28 is more proximate to, or further from, the vertical pulleys 26.

Thus, as the support rod 12 is telescopically lengthened, the lanyard 32 allows for a relative relocation of the translating pulley 28 allowing it to move closer to the vertical pulleys 26. The lanyard 32 is a fixed length and has a first end 34 attached to segment 14 and the other end engaged with the translating pulley 28 or a mount therefor.

When the support rod 12 shortens, the translating pulley 28 moves in the direction of the bias from the lanyard 32 toward the tracking pulley 30 thereby maintaining the distance of the second plane of the cable 22. An adjusting bias of the lanyard 32 increases as the support rod 12 is lengthened which provides the means for maintaining cable 22 running along the length of its formed pathway defined by the path along pulleys 18, 26, and 28.

Effectively, the fixed length of the cable 22 will function operatively at any length of the support rod 12 between a shortest length and its longest length since the movement of the translating pulley 28 provides a means to maintain the length of the pathway of the cable 22 which is employed for traversing the curtains, despite the linear length of telescoping of the support rod 12. For longer lengths, the cable 22 has a first portion of the length of its serpentine path in a first plane lengthened, and a second portion in a second plane shortened. For shorter lengths the cable 22 portion along a first plane is shortened and its return portion in a second plane is lengthened. The lateral adjustment provided by lanyard 32 in conjunction with pulleys 30 and 28 in a tensioned operative engagement about the pulleys provides a means to change the lengths in the planes of operation of the pathway for the cable 22.

In the mode of the device 10 employing the serpentine cable pathway of FIGS. 1-8, and particularly FIGS. 6*a* and 6*b*, the lanyard 32 communicating from engagement at a first end, with the translating pulley mount 29 to a distal end 34 which is in a fixed engagement with the first segment 14 provides means of positional adjustment of the translating pulley 28. This positional adjustment thereby allows the length of pathway for the continuous cable 22 to remain fixed regardless of the aggregate length of the support rod 12 when expanded or contracted. The lanyard 32 engaged to the translating pulley 28 provides a means to reposition the translating pulley mount 29 to offset expansive or contractive length adjustments to support rod 12.

The tracking pulley 30 additionally provides a means for reversing the direction of communication of the lanyard 32 between the translating pulley 28 and distal end 34. As can be seen more clearly in the side view of FIGS. 2, and 6*a*-6*b*, the tracking pulley 30 is operatively engaged with a hub within the axial cavity of the second segment 16 to the mounting plate 15 positioned within the axial cavity of the second segment 16.

Figure 3:
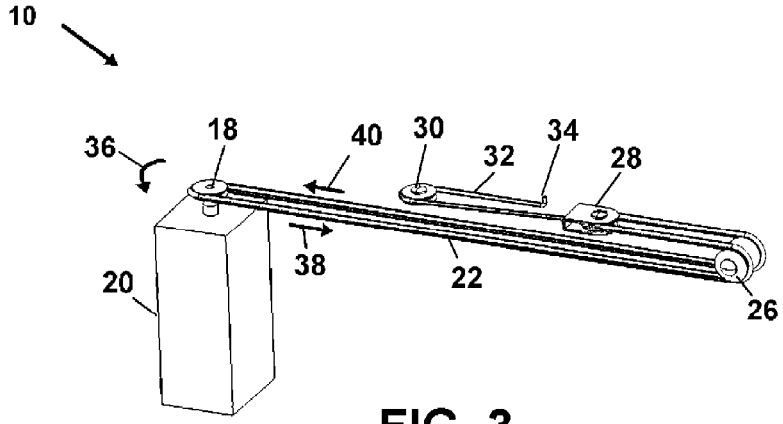
FIG. 3 shows an elevated view of the mode of the device of FIG. 1 with the housing segments omitted for further clarity.

To more clearly describe the preferred mode of employment of the device 10, there is seen in FIG. 3 a view of the device 10 with the support rod 12 omitted to more clearly see the inner-workings of the driving cable 22 and associated pulleys forming its pathway. In use, means for rotation of the drive pulley 18 or any of the other pulleys, such as a conventional user-operated pull cord, or the motor 20, provides a driving force to rotate the drive pulley 18, for example in a first rotational direction 36. It should be noted that an operative engagement of a motor to impart rotation to any of the pulleys of the device will provide translational movement to the cable 22 and consequently the description of engagement to the drive pulley 18 is for example only. Given the continuous nature of the loop of the drive cable 22, and in accordance with the rotational direction 36 as shown in FIG. 6, there is seen both an outgoing portion of cable 38 and an incoming portion of cable 40, relative the drive pulley 18. Of course those skilled in the art will appreciate that if the rotational direction 36 is reversed, the portions of cable 38 and 40, will also be reversed.

In use, window treatments such as curtains or blinds (not shown) will be disposed in a first set engaged on the outgoing portion of cable 38 adjacent the proximal end 19 while a second set (not shown) will be operationally communicating with the incoming portion of cable 40 near the distal end 24, all within the horizontal plane of the drive pulley 18. Activating a switch to provide electrical power to the motor 20 will cause a rotation of the drive pulley 18 in the first rotational direction 36. This rotation translates the opposing sets of draperies operatively engaged and located at the proximal end 19 and distal end 24 respectively, toward a midpoint substantially midway between the proximal 19 and distal end 24. Upon meeting at the aforementioned midpoint a closed position of the drapery is achieved.

As is seen again in FIG. 1, with the support rod 12 shown, there is a substantially centrally located gap 17 communicating along the axial length of the support rod 12 between the distal 24 and proximal 19 ends that allows the operatively engaged draperies to extend from operative communication with the drive cable 22 to the exterior of the support rod 12 through the gap 17. Engagement means of draperies (not shown) to the cable 22 may be any means known in the art such as hooks, rings, ties, hook and loop fasteners, etc.

In yet another particularly preferred mode employing the device 10 to translate one-direction, it may translate curtains (not shown) in the conventional left-to-right or right-to-left open/close configuration. In this mode, the open position may be defined as having a single set of curtains engaged at the proximal end 19 on the outgoing section 38 of cable 22 adjacent the drive motor 20. The closed position may then be achieved by powering the drive pulley 18 in the first direction 36 to translate the cable 22 such that the outgoing section 38 translates the curtains toward the distal end 24, essentially drawing the curtains to cover a window and extend the length of the device 10, achieving the closed position.

Alternatively, the set of curtains may be engaged at the distal end 24 on the incoming section 40 of cable 22. The closed position is then achieved by powering the drive pulley 18 to translate the cable 22 such that the incoming section 40 translates the curtains toward the proximal end 19, again drawing the curtains to cover the window in a conventional closed position.

Although the open and closed positions of drapery achieved by the device 10 is not uncommon, significant improvement and utility is provided by the device 10 through the provision of a telescopically adjustable support rod 12 which is engageable to a motor or other drive and which needs no adjustment of the cable 22 length, nor sawing or cutting of the support rod 12 to install the device 10 in a plurality of lengths. Instead of the conventional need to custom cut each support rod 12 and concurrently, adapt a cable 22 in length to operate the support rod 12 with window treatments such as draperies, the device 10 allows the user to simply lengthen or shorten the telescoping support rod 12 and affix it to the wall or support surface. Thus a varying length support rod 12 has an onboard single length cable 22 which adapts to function when the user easily extends and retracts the support rod 12 as needed to accommodate varying length of windows without the requirement of modifying or altering the mechanical drive components housed within or the cable 22.

Figure 4:
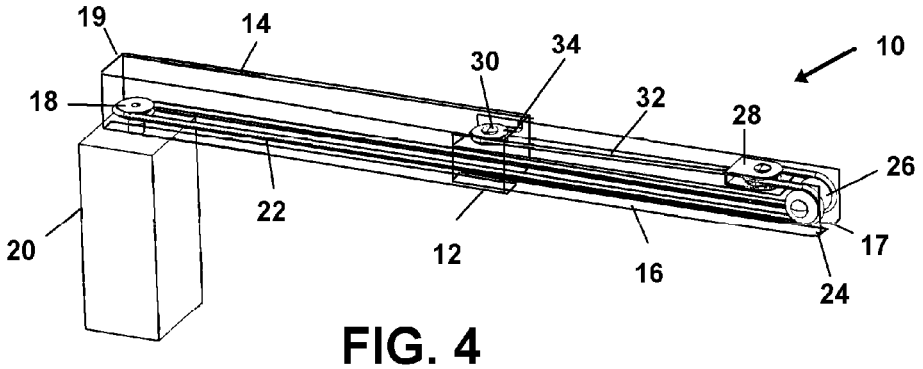
FIG. 4 shows an elevated view of the device with telescopically engaged housing segments in a substantially extended mode, the housing segments are again shown as transparent for clarity.

There is seen in FIG. 4 the device 10 in a substantially extended position extended from a shortest length such as in FIG. 1, to a longest length in a fully extended position. As noted, achieving the fully extended position does not require any user modification of the mechanical components of the device 10 nor the cable length 22 and is ideal for do-it-yourself home installation in this manner. The device 10 is simply extended to the desired length and mounted via conventional means of mounting known in the art.

Figure 5:
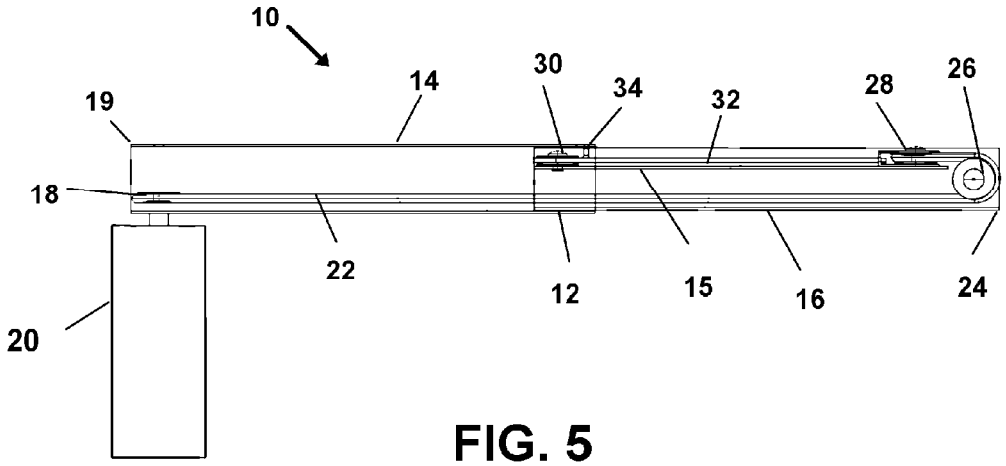
FIG. 5 shows a side view of the mode of the device of FIG. 4.

Referring now to the elevated and side view respectively of FIGS. 4-5, the device 10 is shown with the support rod 12 and segments thereof, in a substantially fully extended position. As mentioned previously, during use the user will preferably maintain the first segment 14 substantially stationary while telescopically translating the distal end 24 of the second segment 16 away from the proximal end 19. During translation of the second segment 16, the translating pulley 28 also slides toward the distal end 24 in order to maintain the length of the pathway for cable 22 by a communication the additional length of cable 22 to the lower, horizontal plane of the drive pulley 18 defining the extended distance. Concurrently, the tracking pulley 30 translates in its engagement with the second segment 16 while the lanyard 32 maintains communicates about the tracking pulley 30, until full extension between the translating pulley 28 and tracking pulley 30 is achieved as is shown.

FIG. 6 shows again an elevated view of the device 10 with the support rod 12 omitted for clarity depicting the device 10 in the fully extended position of FIG. 5. As can be seen, the mechanical operations of the device 10 for translating the outgoing 38 and incoming 40 portions of cable 22 are the same as they were in the retracted position of FIGS. 1-3 without requiring any user modification or alteration of the pulleys, motor, or cable. Further, in FIGS. 1 and 4, the gap 17 along the longitudinal length of the support rod 12 allows the communication of operatively engaged draperies (not shown) to extend from the cable 22 to the exterior of the support rod 12 as needed. The pathway of the cable 22 in a serpentine fashion through the device 10 can also be seen in FIGS. 6*b* and 6*c*, which are enlarged to show the pathway formed by the components of FIGS. 1-5 for clarity.

A still further particularly preferred mode of the device 10 is shown in the side view of FIG. 7. In this mode, the device 10 shown in a fully substantially extended position, and includes a drive pulley housing 13 located at the proximal end 19 and substantially covering the drive pulley 18. With the motor 20 and housing 13 engaged on the device 10, the internal mechanized components are protected against contact with the walls or draperies or the like. Again the device support rod 12 is depicted as transparent so as to more clearly depict the mechanical drive components housed within. However, in light of the application they are preferably an opaque material such as a plastic or lightweight metal like aluminum.

In another view, the device 10 of FIG. 7 is shown in an elevated view of FIG. 8, with the support rod 12 omitted in its entirety to fully show the drive pulley 18, vertical pulleys 26, and translating pulley 28 which combined to define the pathway for the drive cable 22. Also shown are the lanyard 32 and tracking pulley 30 which as noted adjust the positioning of the pathway for the drive cable 22 to maintain its length. Additionally there is included in this mode spring tensioning elements 27 engaged to the vertical pulleys 26 providing an ongoing biasing force allowing the device 10 to more advantageously maintain the working tension of the cable 22.

Another preferred mode of the device 10, providing similar utility with the same ease of installation and adaptability of the length of the support rod 12, to accommodate a wide range of installation widths, is shown in FIGS. 9-11, which like all other modes of the device 10 is easily installed by homeowners. This is achieved because the once labor-intensive adjustment of the length of the support rod 12 is achieved by a simple translation of the first segment 14 relative to the engaged second segment 16 to telescope the support rod 12 to adjust the ultimate length thereof to the installation site. The flexible member or cable 22 requires no adjustment whatsoever when the support rod 12 is adjusted between its minimum and maximum lengths as its pathway length is maintained.

As shown in the FIGS. 9-11 an additional mode of the device 10 is provided having an alternative configuration of components which yield a crossover of the pathway for the cable 22 rather than the parallel running pathway for cable 22 and translating pulley 28 of earlier noted modes.

In the crossover mode, the first segment 14 translates in telescopic engagement with the second segment 16 between the minimum and maximum length of the support rod 12. The cable 22 forming the flexible member is engaged with a drive pulley 18, and a plurality of vertical pulleys 25 and 26 engaged to both the first segment 14 and second segment 16. The drive pulley 18 at the proximal end 19 of the support rod 12 is engaged in first segment 14 and two vertical pulleys 26 are engaged to the second segment 16 having a distal end 24.

The crossover serpentine engagement of the pathway of the cable 22 defined by its pathway along the pulleys 26 and 18 as can be clearly seen in FIG. 11, allows the cable 22 to be fixed in length at manufacture of the support rod 12 thereby eliminating the need to change the cable length when the length of the support rod 12 gets larger or smaller. Instead, the distance between the two vertical pulleys 26 shortens when the support rod 12 is translated to lengthen, and lengthens when the support rod 12 telescopically collapses to accommodate the length changes. When the drive pulley 18, is driven in an angular direction 37, there are similarly an outgoing 38 and incoming 40 portions of the cable 22 traveling in opposite directions when the device is operated. As such, operatively engaged supports for the draperies or curtains (not shown) thereby translate along a path with the segment-formed support rod 12. Movement of the fixed length continuous cable 22 or other suitable flexible member, as noted, can be by operative engagement of a hand-operated secondary flexible member, or motorized power, communicating with the drive pulley 18, which then provides the drive force to operate the system. Further, as noted above, the power from the electric motor or a hand operated device, can be communicated to any of the pulleys along the pathway of flexible member shown as the cable 22 and provide the requisite translation of the first portion of the cable 22 to translate an operatively engaged window treatment. Consequently any means to impart translation to the cable 22 as would occur to those skilled in the art, to a communication of rotation to any of the pulleys shown on the pathway, or some other cable-engaging means for inducing a translation, is considered within the scope of this invention.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth.

The disclosed device 10 provides a novel solution to the drawbacks of conventional mechanically retractable window treatment systems and apparatuses which provide retractable window treatment mounts. This device advantageously allows a user to easily extend and retract the housing to an infinite number of desired lengths between the maximum and minimum lengths of the support rod since the segments can always be translated a minuscule amount in relation to each other, and this can be done without the need to alter or modify the mechanical drive components. As such no technical expertise is required for either installation or employment the device 10 which is of great advantage over prior art.

It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A variable length support rod apparatus for translational support of a window treatment, comprising:

a support member having a length defined by a distance between a first end and a second end of said support member;

said support member formed of a plurality of segments, each said segment being in translational engagement with an adjacent said segment;

said support member configurable to a minimum length through translation of said segments toward each other to a fully contracted configuration;

said support member configurable to a maximum length through translation of said segments away from each other to a fully extended configuration;

said length of said support member being variable between said minimum length and said maximum length;

a continuous flexible member positioned along a member pathway running between said first end and second end of said support member;

a first portion of said flexible member extending a first length, between said first end and said second end of said support member;

a second portion of said flexible member extending a second length, between said second end of said support member and a movable return located in a central portion of said support member;

said moveable return being movable relative to said second end of said support member;

said second length of said second portion of said flexible member decreasing and said first length of said first portion of said flexible member concurrently increasing, during any increase of said length of said support member;

said second length of said second portion of said flexible member increasing and said first length of said first portion of said flexible member concurrently decreasing, during any decrease of said length of said support member;

translation of said first portion of said flexible member providing means for a translation of a window treatment adapted for support by said support member; and whereby said support member being configurable to any said length between said minimum length and said maximum length of said support member, and being configurable to be fixed to a support surface without an adjustment of a fixed length of said flexible member.

2. The apparatus of claim 1 wherein said member pathway comprises:

a first pulley disposed and rotating about a first axis, said first pulley in a rotational engagement adjacent to said first end of said support member;

two second pulleys positioned adjacent to said second end of said support member, each of said second pulleys rotating about an axis traverse to said first axis;

a return pulley engaged with said movable return, said return pulley rotating about a third axis in a plane substantially traverse to said first axis; and a rotation of said first pulley causing a translation of said flexible member along said member pathway, said translation of said flexible member providing said translation to said window treatment adapted to engage with said first portion of said flexible member.

3. The apparatus of claim 1 wherein said movable return comprises:

a flexible lanyard engaged at a first end with said movable return;

a fourth pulley rotationally engaged to a mount positioned at a point of engagement to a said segment extending to said second end of said support member;

a second end of said lanyard engaged with said segment extending to said first end of said support member;

a lanyard pathway extending in a first direction from said moveable return toward said first end of said support member; and said lanyard pathway traversing said fourth pulley and reversing direction toward said second end engaged with said wall.

4. The apparatus of claim 2 wherein said movable return comprises:

a flexible lanyard engaged at a first end with said movable return;

a fourth pulley rotationally engaged to a mount positioned at a point of engagement to a said segment extending to said second end of said support member;

a second end of said lanyard engaged with said segment extending to said first end of said support member;

a lanyard pathway extending in a first direction from said moveable return toward said first end of said support member; and said lanyard pathway traversing said fourth pulley and reversing direction toward said second end engaged with said wall.

5. The apparatus of claim 1 wherein said plurality of segments equals two.

6. The apparatus of claim 2 wherein said plurality of segments equals two.

7. The apparatus of claim 3 wherein said plurality of segments equals two.

8. The apparatus of claim 4 wherein said plurality of segments equals two.

9. The apparatus of claim 1 additionally comprising:

one of a first pulley, two second pulleys offset from said first pulley, and a return pulley engaged with said moveable return, being configured for rotational engagement with an electric motor; and a rotation of said electric motor in said rotational engagement imparting said translation to said first portion of said flexible member.

10. The apparatus of claim 2, wherein:

one of said first pulley, said two second pulleys, and said return pulley, being configured for rotational engagement with an electric motor; and a rotation of said electric motor in said rotational engagement imparting said translation to said first portion of said flexible member.

11. The apparatus of claim 3 additionally comprising:

one of a first pulley, two second pulleys offset from said first pulley, and a return pulley engaged with said moveable return, being configured for rotational engagement with an electric motor; and a rotation of said electric motor in said rotational engagement imparting said translation to said first portion of said flexible member.

12. The apparatus of claim 4, wherein:

one of said first pulley, said two second pulleys, and said return pulley, being configured for rotational engagement with an electric motor; and a rotation of said electric motor in said rotational engagement imparting said translation to said first portion of said flexible member.

13. The apparatus of claim 5 additionally comprising:

one of a first pulley, two second pulleys offset from said first pulley, and a return pulley engaged with said moveable return, being configured for rotational engagement with an electric motor; and a rotation of said electric motor in said rotational engagement imparting said translation to said first portion of said flexible member.

14. The apparatus of claim 6, wherein:

one of said first pulley, said two second pulleys, and said return pulley, being configured for rotational engagement with an electric motor; and a rotation of said electric motor in said rotational engagement imparting said translation to said first portion of said flexible member.

15. The apparatus of claim 7 additionally comprising:

one of a first pulley, two second pulleys offset from said first pulley, and a return pulley engaged with said moveable return, being configured for rotational engagement with an electric motor; and a rotation of said electric motor in said rotational engagement imparting said translation to said first portion of said flexible member.

16. The apparatus of claim 8, wherein:

one of said first pulley, said two second pulleys, and said return pulley, being configured for rotational engagement with an electric motor; and a rotation of said electric motor in said rotational engagement imparting said translation to said first portion of said flexible member.

* * * * *